United States Patent [19]

Seibold

[11] 3,977,746

[45] Aug. 31, 1976

[54] OUTLET DEVICE

[76] Inventor: Paul F. Seibold, 26665 York Road, Huntington Woods, Mich. 48070

[22] Filed: Jan. 31, 1973

[21] Appl. No.: 328,421

[52] U.S. Cl. ..... 339/32 R; 339/158

[51] Int. Cl.[2] ..... H01R 13/50

[58] Field of Search ..... 339/31–33, 339/154, 155, 156, 158, 159, 161, 157, 167, 168

[56] References Cited

UNITED STATES PATENTS

| | | | |
|---|---|---|---|
| 1,569,528 | 1/1926 | Yager | 339/158 |
| 1,751,442 | 3/1930 | Clemence | 339/158 |
| 1,815,013 | 7/1931 | Slade et al. | 339/168 |
| 2,134,204 | 10/1938 | Regis | 339/168 |
| 2,147,790 | 2/1939 | Hamilton | 339/168 X |
| 2,221,505 | 11/1940 | Benander | 339/167 |

*Primary Examiner*—Roy D. Frazier
*Assistant Examiner*—Terrell Lewis
*Attorney, Agent, or Firm*—Harness, Dickey & Pierce

[57] ABSTRACT

An electric outlet device has spaced contacts for a pronged plug within a housing which are located in a plane at right angles to a threaded plug depending from the housing. A socket is provided above the spaced contacts into which the threaded end of a lamp bulb may be screwed. The threaded base and socket are interconnected by conductors between the terminals and between the threaded elements each of which is connected to one of the contacts. Two like halves of a housing are joined together about the threaded socket and the two spaced contacts and adhered together and to the top of the threaded plug to form the outlet device.

3 Claims, 4 Drawing Figures

FIG. 1.
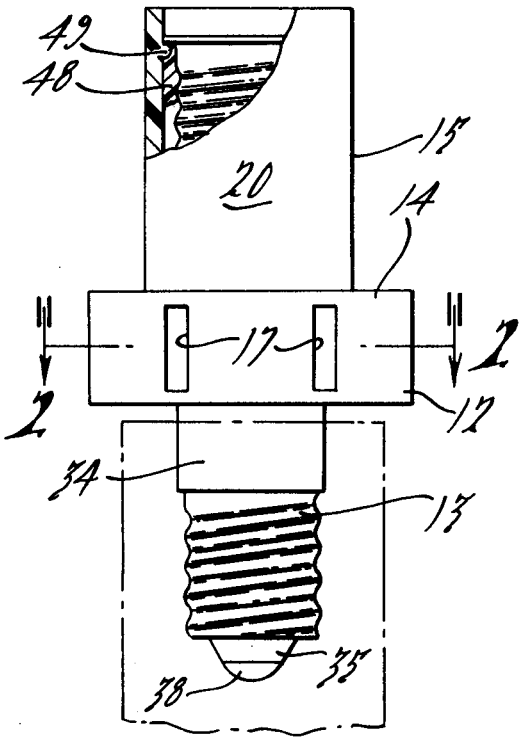
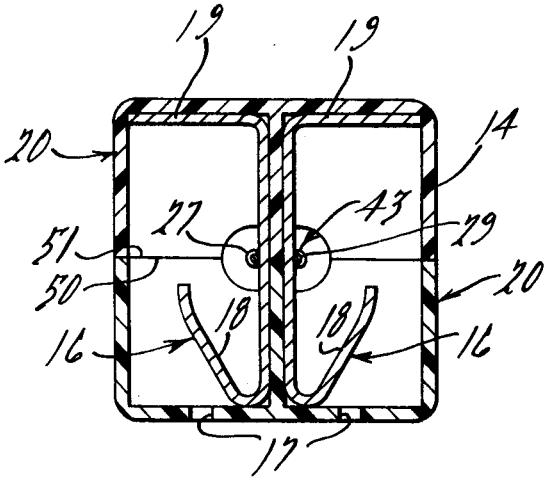
FIG. 2.
FIG. 3.
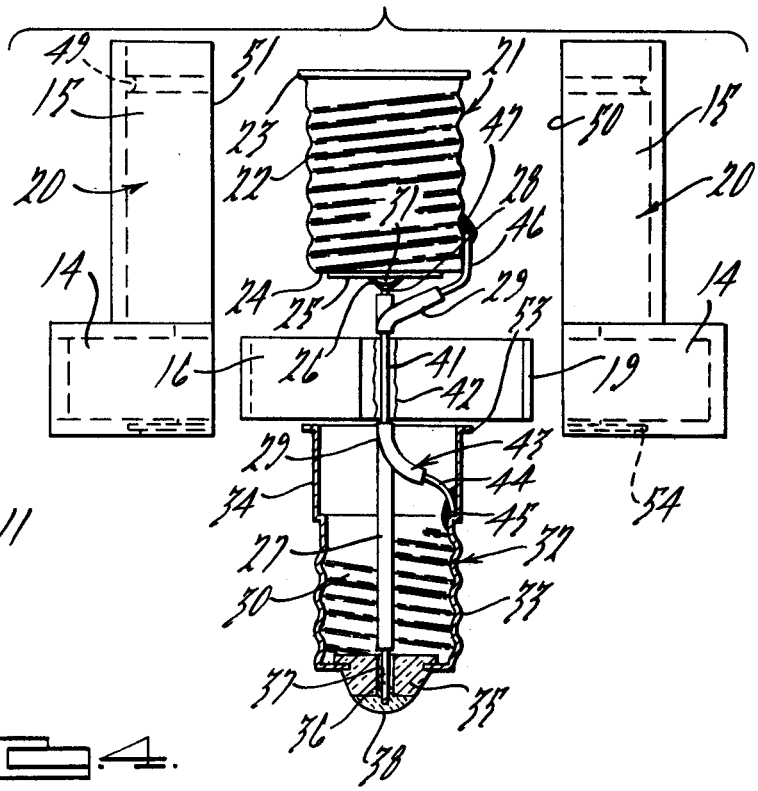
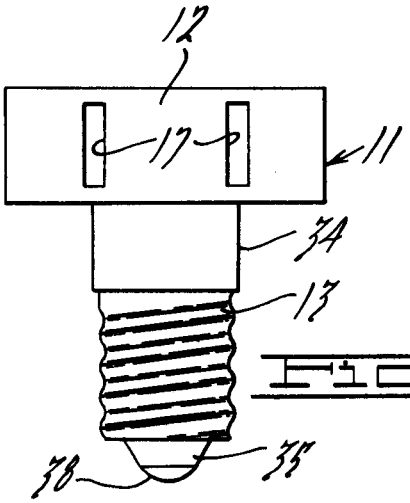
FIG. 4.

OUTLET DEVICE

BACKGROUND OF THE INVENTION

An outlet device having contacts for a pronged plug is known in the art, the contacts for the prongs being disposed parallel to the axis of the threaded plug portion.

SUMMARY OF THE INVENTION

The invention pertains to an outlet device having a housing containing a pair of contacts for the spaced prongs of a plug and a threaded plug therebelow. A threaded socket may be mounted within the upper portion of the housing above the contacts for the pronged plug for supporting and energizing a light bulb. With this arrangement, power from a chandelier may be supplied to a string of lights supported thereon by removing a light bulb from a socket and screwing the threaded plug of the outlet device thereinto. This provides an outlet for the pronged plug and also a socket for the lamp bulb. The lamp bulb is of substantial length and the outlet device with a smaller lamp bulb provides an overall length substantially that of the length of the removed lamp bulb. By employing the unit having the threaded base or plug with the outlet for the pronged plug disposed normal thereto, the height is substantially reduced and only the projecting housing appears over the chandelier socket. However, by using the unit having the lamp bulb socket in extension of the contacts, the space between the lamps on the chandelier is maintained and a more pleasing and balanced appearance is retained by the chandelier.

BRIEF DESCRIPTION OF THE DRAWING

FIG. 1 is a broken view in elevation of the outlet device of the present invention;

FIG. 2 is a sectional view of the structure illustrated in FIG. 1, taken on the line 2—2 thereof;

FIG. 3 is an exploded view of the elements which are secured together to produce the outlet device illustrated in FIG. 1, and FIG. 4 is a view of the structure illustrated in FIG. 1 with the omission of the upper portion of the housing containing the threaded socket element.

DESCRIPTION OF THE PREFERRED EMBODIMENTS

The outlet device 11 illustrated in FIG. 4 comprises a housing 12 and a threaded plug 13. In FIG. 1, the screw in plug 13 is shown attached to a housing portion 14, which is the housing portion 12 of the outlet illustrated in FIG. 4, having a cylindrical portion 15 extending upwardly therefrom. Each housing section 20 of FIG. 1 is therefore made up of a semi-cylindrical socket retaining portion 15 and one-half of the contact retaining portion 14. The contact retaining portion 14 has contacts 16 therein for the prongs of a plug which are aligned with a pair of elongated openings 17 through one side wall of the housing portion 14. Each contact 16 is a strip of metal, which may be hard copper or bronze, having a reversely bent end 18 and a straight body portion from the opposite end of which a right-angle extension 19 is provided. A threaded socket 21 is made from a cylindrical metal sleeve having a thread portion 22 and an outwardly extending flange 23 at the top. An inwardly extending flange 24 at the bottom supports an insulation disk 25 having a contact 26 on the central axis thereof. An insulated wire 27 has the end 28 cleared of the insulation 29 and secured by a drop of solder 31 to the central contact 26.

A threaded plug 32 has a metal body 30 of cylindrical form provided with a thread 33 below an upper cylindrical portion 34 and an insulating element 35 at the bottom. The cleared end 36 of an insulated wire 27 passes through an aperture 37 on the axis of the element 35 and is secured at the end by a drop of solder 38. The central upper portion 41 of the insulated wire 27 has a section of the insulation 29 removed and the cleared wire attached by solder 42 to a contact 17. A second insulated wire 43 has the end 44 cleared of the insulation 29 and is secured by a drop of solder 45 to the inner surface of the metal body 30 of the threaded plug 32. The upper end 46 of the insulated wire 43 likewise has the insulation 29 removed so that the bared conductor can be secured by a drop of solder 47 to the outer surface of the threaded socket 21. The central portion 44 of the insulated wire 43 has the insulation 29 removed so that the bared conductor can be secured by solder 42 to the other of the contacts 17, as illustrated in FIGS. 2 and 3.

After the two insulated wires 29 and 43 are secured in this manner, the two substantially like housing portions 20 are moved from the position illustrated in FIG. 3 toward each other to secure the two contact elements 16, as illustrated in FIG. 2, and to encompass the threaded socket 21, as illustrated in FIG. 1. Before moving the two housing portions 20 toward each other, adhesive material 48 is applied to the inside of the uper semi-cylindrical portion 15 thereof which will shape to the thread of the socket 21 and upon hardening will retain the socket in fixed position. The socket is limited in its inward movement by the outwardly extending annular top flange 23 which rests upon a ledge 49 with the housing portions 20. It is to be understood that the adhesive material 48 is a solvent, an epoxy or like substance applied to one or both faces 50 and 51 and to slots 54 of the housing portions 20 which secures the two portions in unit relation when hardened. A flange 53 at the top of the metal body 30 moves into the slot 54 in the edge of an aperture in the bottom wall of the housing portions 20 when moved into engagement with each other and will be secured in position by additional adhesive material. The two portions 20 are exactly the same except for the one portion 14 having the elongated apertures 17 provided through the one wall thereof. The apertures are produced by projecting elements within the die set which are removed when the other housing portion 20, that without the apertures 17, is being molded.

The outlet device illustrated in FIG. 4 is exactly the same as that illustrated in FIG. 1 except for the omission of the semicylindrical portion 15 of the housing portions 20 and the omission of the threaded socket 21. The outlet device was constructed to meet a long-felt want that for decorating a chandelier illuminated by a plurality of simulated candle lights. These lights are made of cylindrical tubes having threaded sockets at the upper end in which a light bulb is supported and from which they are energized and illuminated. When a multiplicity of small lights are hung upon the chandelier for decorative purposes, there is no way to connect the prong plug to a socket for energizing the lights. The lamp bulbs have a threaded contact end which has an overall diameter of approximately one-half inch and is substantially smaller than that of the standard lamp bulb. When it is desired to only have an outlet for the pronged plug, the outlet device of the present invention illustrated in FIG. 4 is employed. This permits the housing portion 12 to rest upon the top of the cylindrical tube forming the body of the light with the prongs of the plug inserted into engagement with the contacts 16 which are mounted in a plane normal to the axis of the threaded plug which extends downwardly from the housing 12. When the arrangement is such that the omission of a light from the chandelier is obvious and spoils the effect of the ornamental lights, then the outlet device illustrated in FIG. 1 is utilized. The light bulb with its threaded plug at the end is substantially longer than the outlet device illustrated in FIG. 1 so that a small light inserted in the socket 21 will extend to the top of the other light bulbs and a uniform appearance of the chandelier will be retained. A cylindrical tube 52 is illustrated in dot and dash line in FIG. 1. The sleeve 34 lengthens the threaded plug 32 so that the housing portion 14 will extend above the tube. This was necessary as the glass of the light bulb extended into the tube when supported thereon by the threaded plug 32.

I claim:

1. In an electric outlet plug, an insulated housing, a threaded socket within said housing, a threaded plug below said housing, a socket having spaced slots for a pronged plug within said housing between said threaded socket and plug, said slots being aligned with the thread on said threaded plug, and spaced contacts aligned with said slots each having an L-shaped section which retains the contacts fixed within the chambers in insulated relation to each other.

2. In an electric plug outlet, a housing of insulating material split into two halves on a vertical central plane, a threaded socket within the upper portion of said housing, said housing having spaced slots for a pronged plug below said socket, a metal sleeve having a bottom threaded end to form a plug, said metal sleeve having a laterally extending flange on the top edge, and a recess in the bottom portion of the housing with which said flange engages.

3. In an electric plug as recited in claim 2, wherein an adhesive retains the housing halves in fixed relation to each other.

* * * * *